United States Patent [19]

Ball et al.

[11] Patent Number: 4,608,936

[45] Date of Patent: Sep. 2, 1986

[54] APPARATUS FOR AUTOMATICALLY FABRICATING CUT AND EDGE STITCHED TEXTILE ARTICLES

[75] Inventors: Gregory A. Ball, Mooresville; Byron E. Moore, Kannapolis; John D. Haynes, Faith; James N. Moser, Kannapolis, all of N.C.

[73] Assignee: Cannon Mills Company, Kannapolis, N.C.

[21] Appl. No.: 799,163

[22] Filed: Nov. 18, 1985

[51] Int. Cl.[4] ..... D05B 21/00; D05B 27/08

[52] U.S. Cl. ..... 112/121.12; 112/121.15; 112/104; 112/153; 112/306; 112/309

[58] Field of Search ..... 112/121.11, 121.12, 112/121.15, 121.29, 104, 303, 306, 309, 308, 153

[56] References Cited

U.S. PATENT DOCUMENTS

| | | | |
|---|---|---|---|
| 3,232,256 | 2/1966 | Buckalter . | |
| 3,433,187 | 3/1969 | Haefele et al. . | |
| 3,528,378 | 9/1970 | Westhoff . | |
| 3,531,107 | 9/1970 | Rovin et al. | 112/121.11 X |
| 3,580,198 | 5/1971 | Teed . | |
| 3,670,675 | 6/1972 | Rovin et al. | 112/121.12 |
| 3,722,435 | 3/1973 | Elsas . | |
| 4,296,699 | 10/1981 | Vartoukian . | |
| 4,425,858 | 1/1984 | Hargett | 112/121.12 |
| 4,435,837 | 3/1984 | Abernathy | 112/121.12 X |
| 4,470,362 | 9/1984 | Kear . | |
| 4,498,404 | 2/1985 | Sadeh | 112/121.12 |

*Primary Examiner*—H. Hampton Hunter

*Attorney, Agent, or Firm*—Bell, Seltzer, Park & Gibson

[57] ABSTRACT

An apparatus for automatically fabricating cut and edge stitched articles, such as washcloths and the like from a continuous length of textile material includes the following mechanisms. Mechanisms successively withdraw predetermined lengths of textile fabric from a supply source along a path of travel in a longitudinal direction of the fabric. Cutting mechanisms are positioned in the path of travel of the fabric for successively transversely cutting the fabric into individual articles of predetermined dimensions. Mechanisms successively feed the cut articles from the cutting mechanisms in a generally straight-line path of travel and to mechanisms for squaring the cut articles in the path of travel. A robot successively picks up the cut articles from the squaring mechanisms and transports the cut articles to edge stitching mechanisms which complete fabrication of the article.

10 Claims, 22 Drawing Figures

APPARATUS FOR AUTOMATICALLY FABRICATING CUT AND EDGE STITCHED TEXTILE ARTICLES

FIELD OF THE INVENTION

This invention relates to an apparatus for automatically fabricating cut and edge stitched articles, such as washcloths and the like, from a continuous length of textile fabric.

BACKGROUND OF THE INVENTION

Heretofore, it has been the practice in fabricating such cut and edge stitched articles, particularly washcloths and the like, to feed a continuous length of textile fabric to a cutting mechanism and cut the fabric into individual articles of predetermined dimensions. These individually cut articles were then stacked up and taken to sewing machines where an operator fed the individual cut articles into the sewing machines which would edge stitch these cut articles around all four sides to complete fabrication thereof and produce a finished article, such as a washcloth or the like.

This article fabricating operation was excessive in operator time and expense because of the separately performed fabricating steps.

OBJECT AND SUMMARY OF THE INVENTION

It is the object of this invention to automate the above described fabricating operation and to eliminate excessive operator time and expense by providing an automatic apparatus for effecting such article fabrication.

By this invention, it has been found that this object may be accomplished by providing an apparatus for automatically fabricating cut and edge stitched articles, such as washcloths and the like, from a continuous length of textile fabric which includes generally the following.

Mechanisms successively withdraw predetermined lengths of the textile fabric from a supply source along a path of travel in a longitudinal direction of the fabric. Cutting devices are positioned in the path of travel of the textile fabric for successively transversely cutting the textile fabric into individual articles of predetermined dimensions. Mechanisms successively feed the cut articles from the cutting devices in a generally straight-line longitudinal path of travel. Devices receive the cut articles from the feeding mechanisms and square the cut articles in the straight-line longitudinal path of travel. Robot means are positioned for picking up the cut articles at the squaring mechanisms and transporting the cut articles to edge stitching machines which receive and edge stitch the cut articles to complete fabrication thereof.

Thus, articles, such as washcloths and the like, are automatically and continuously fabricated from a continuous length of textile fabric without interruption and without excessive operator time.

BRIEF DESCRIPTION OF THE DRAWINGS

While some of the objects and advantages of this invention have been set forth above, other objects and advantages will appear as the detailed description of preferred embodiments of this invention continues when taken in conjunction with the accompanying drawings, in which.

DETAILED DESCRIPTION OF PREFERRED EMBODIMENTS OF THE INVENTION

Figure 1:
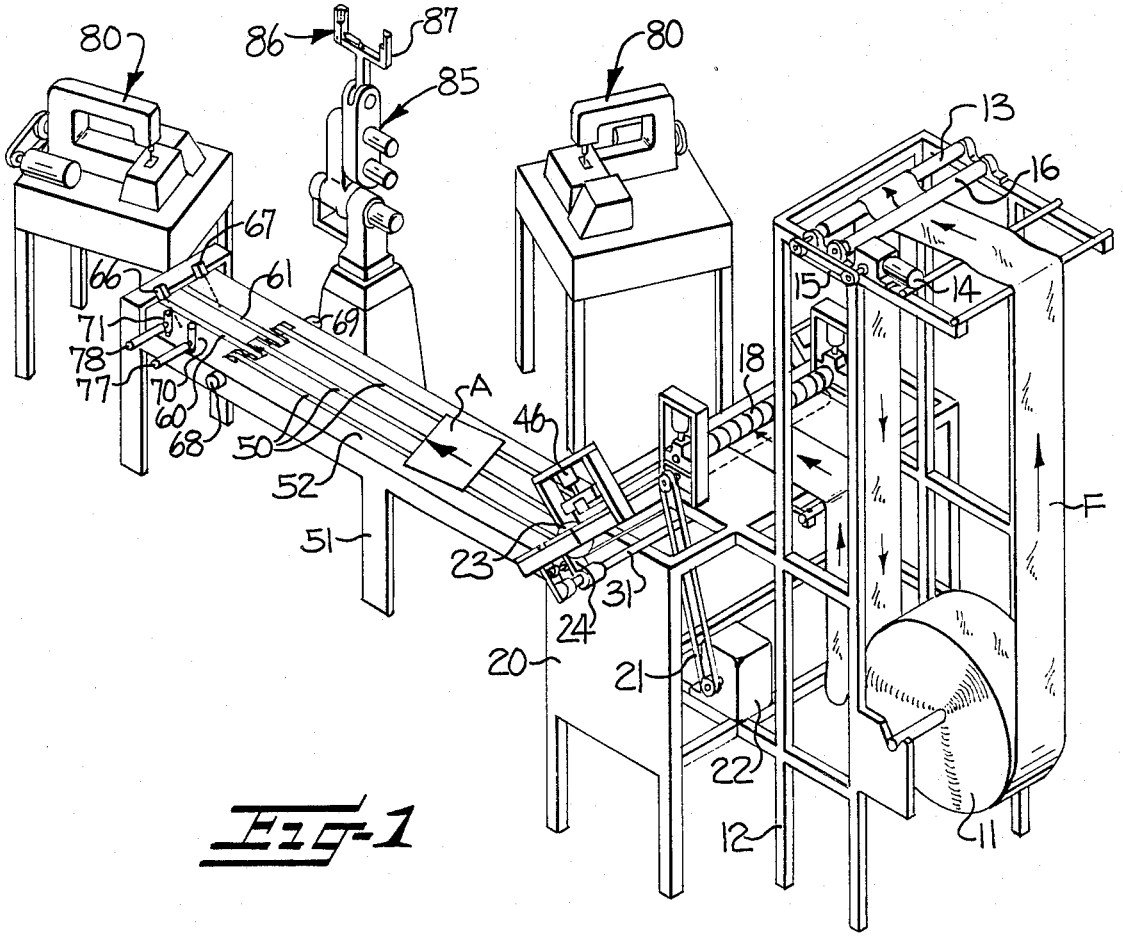
FIG. 1 is a perspective, somewhat schematic, view of a first embodiment of apparatus constructed in accordance with this invention.
Figure 2:
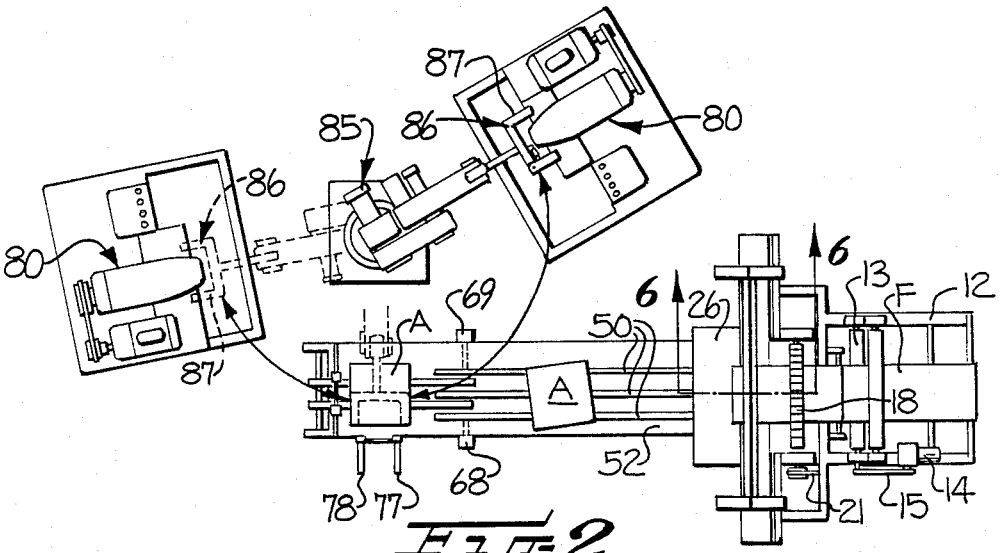
FIG. 2 is a top plan view of the apparatus of FIG. 1.
Figure 3:
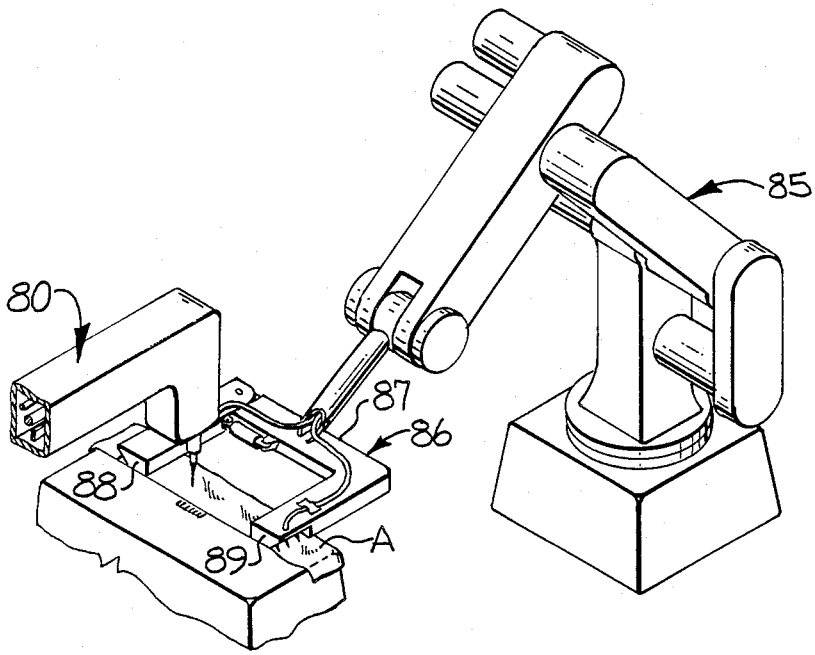
FIG. 3 is a perspective, somewhat schematic, view of robot means and one stitching means utilized in the apparatus of FIG. 1.
Figure 4:
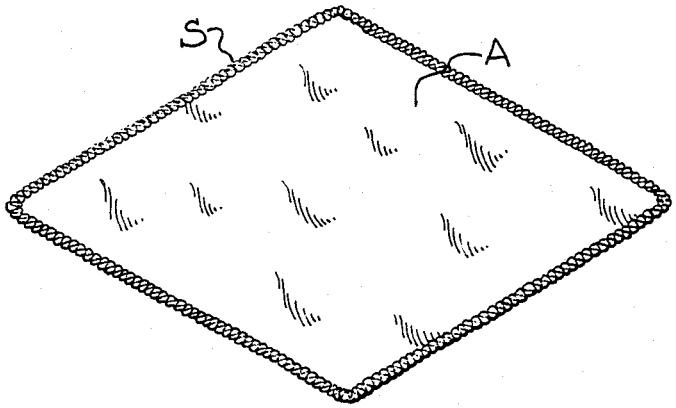
FIG. 4 is a perspective view of a washcloth constructed by apparatus in accordance with this invention.

Referring now to the drawings, there is illustrated in FIG. 4 a cut and edge stitched article A in the form of a washcloth which has been automatically cut from a continuous length of textile fabric F and edge stitched around its periphery by stitching S. In FIGS. 1–3 and 5–14 there is illustrated a first embodiment of apparatus for automatically fabricating the cut and edge stitched articles A, and in FIGS. 15–22 there is illustrated a second embodiment of apparatus for automatically fabricating the cut and edge stitched articles A.

Referring now to the first embodiment of apparatus of FIGS. 1–3 and 5–14, this apparatus includes a supply source of continuous textile fabric F. This supply source may conveniently be in the form of a roll 11 of textile fabric F supported on an apparatus frame section 12 for being rotated to unwind the roll of textile fabric F. This supply source further includes a driven feed roll 13 supported on the apparatus frame section 12 and driven by a suitable motor 14 through a suitable belt and pulley drive 15. The continuous length of textile fabric F passes from the supply roll 11 over the driven feed roll 13 after passing under an idler guide roll 16 which is also rotatably mounted on the apparatus frame 12 and then forms a loose loop of textile fabric F (FIG. 1) for supply in the further fabricating operations in the apparatus.

This first embodiment of apparatus further includes means for successively withdrawing predetermined lengths of the textile fabric F from the supply source and along a path of travel in a longitudinal direction of the fabric F. Specifically, this means includes a driven feed roll 18 suitably mounted on a further section 20 of apparatus frame and driven by a belt and pulley drive 21 from a suitable motor 22. This feed roll 18 cooperates with an idler roll 19 (FIG. 6) and includes suitable devices, as shown, for varying the pressure between idler roll 19 and feed roll 18. The rolls 18, 19 are rotated to withdraw a predetermined length of the textile fabric F from the supply source 11 and feed such predetermined length forwardly of the rolls 18, 19. Suitable control mechanisms (not shown) are provided for controlling operation of the feed roll 18 and for controlling operation of the feed roll 13 of the supply source to effect the above described operations.

The first embodiment of apparatus further includes cutting means positioned in the path of travel of the textile fabric F for successively transversely cutting the textile fabric F into individual articles A of predetermined dimensions.

This cutting means (FIGS. 6 and 7) is carried by the apparatus frame section 20 for transversely cutting the length of textile fabric F which has been fed forwardly of the rolls 18, 19 by the above described means for successively withdrawing predetermined lengths of textile fabric F. This cutting means includes a rotating circular blade 23 rotatably mounted on a carriage mechanism 24 mounted for movement transversely across the textile fabric F for carrying the rotating cutting blade 23 through a cutting slot 25 in a stationary guide plate 26 mounted on the apparatus frame section 20. The carriage mechanism 24 is mounted on and guided by two stationary guide rods 28, 29 carried by the frame section 20. Means are provided for alternately moving the carriage mechanism 24 in a first direction transversely across the textile fabric F for a cutting action by the rotating cutting blade 23 and then in the opposite direction transversely across the textile fabric F for another cutting action by the rotating cutting blade 23. Means are also provided for alternately rotating the cutting blade 23 in one direction as the carriage mechanism 24 moves in its first direction and then in the opposite direction as the carriage means 24 moves in its opposite direction.

The means for alternately moving the carriage mechanism 24 includes a double-acting fluid-operated piston and cylinder mechanism 30, 31 in which the piston 30 is secured to the carriage mechanism 24 and the cylinder 31 extends transversely across the apparatus and the textile fabric F. The piston and cylinder mechanism 30, 31 is controlled by suitable solenoid-operated valves 32, 33 positioned in fluid supply lines 34, 35 to opposite ends of the cylinder 31, so that fluid can be supplied respectively to the opposite ends of the cylinder 31 upon actuation of the respective solenoid-operated valves 32, 33 for moving the carriage mechanism 24 and the rotating cutter blade 23 in the back and forth movements transversely across the textile fabric F. Rotation of the circular cutting blade 23 is also accomplished by fluid-operated means in the form of solenoid-operated valves 37, 38 in fluid supply lines 39, 40 which respectively effect opposite rotation of the circular cutting blade 23. Actuation of these solenoid-operated valves 37, 38 is coordinated with actuation of the solenoid-operated valves 32, 33 for the piston and cylinder mechanisms 30, 31 of the carriage mechanism 24 so that rotation of the circular cutting blade 23 is in the direction of movement of the carriage mechanism 24.

The cutting means also includes means for clamping or holding the textile fabric F on each side of the slot 25 in the guide plate 26 so that the textile fabric F does not move during the above described cutting action of the rotating cutting blade 23. This clamping means may include a pair of finger members 42, 43 which may be mounted for slight pivotal outward movement against a bias (not shown) to effect a slight spreading action when the blades 42, 43 are brought into engagement with the textile fabric F on each side of the slot 25 in the guide plate 26. The clamping blades 42, 43 are mounted for upward and downward movement on each end thereof by a carriage device 44 movably carried on guide rods 45 and by fluid-operated piston and cylinder mechanisms 46 and operated by a solenoid-operated valve 47 in fluid supply lines 48, 49 connected to opposite sides of the piston and cylinder mechanisms 46 so that the solenoid-operated valve 47 will control the above described up and down movement of the clamping blades 42, 43 in coordination with a cutting action by the cutting blade 23.

Figure 5:
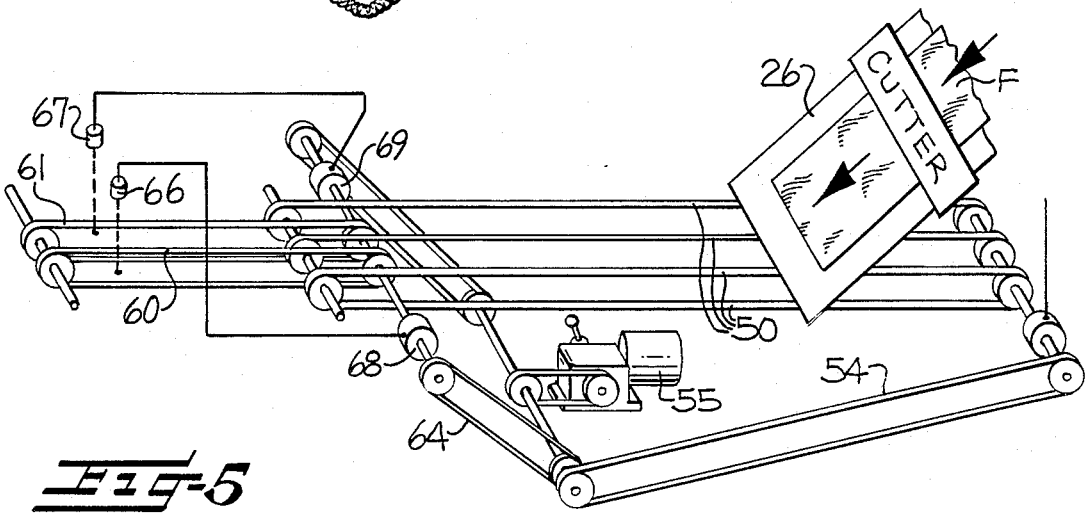
FIG. 5 is a schematic perspective view of the drive and control mechanisms utilized in the means for squaring the cut articles of the apparatus of FIG. 1.
Figure 6:
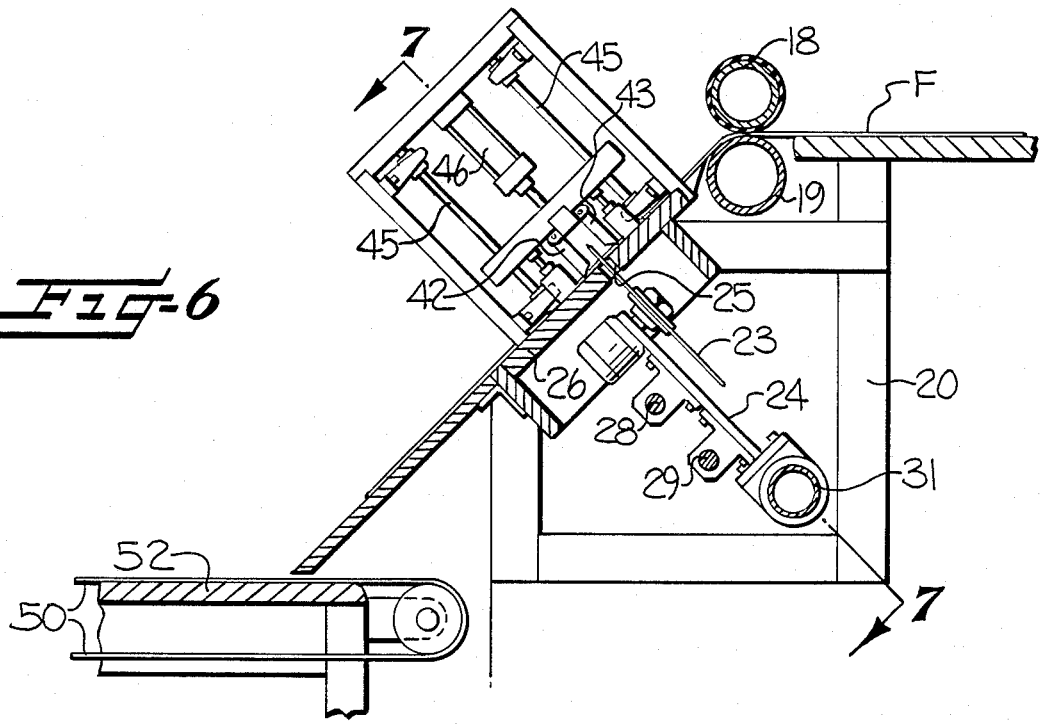
FIG. 6 is a sectional view through cutting devices of the apparatus of FIG. 1 and taken generally along the lines 6—6 of FIG. 2.
Figure 7:
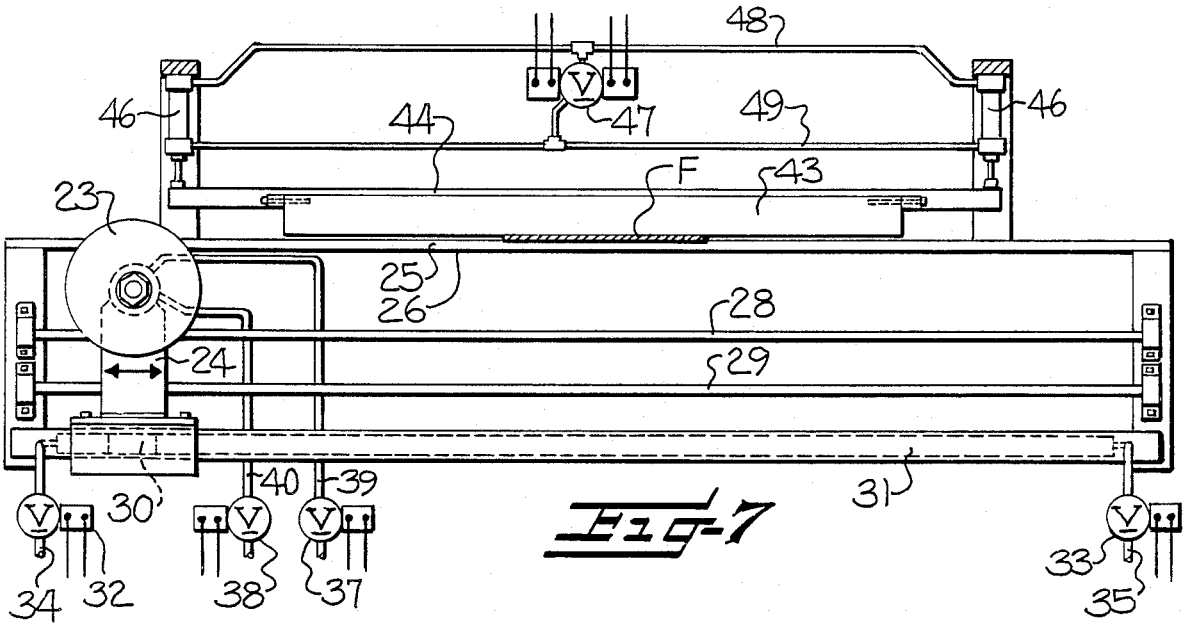
FIG. 7 is a sectional view taken generally along the lines 7—7 of FIG. 6.

The first embodiment of apparatus further includes means for successively feeding the cut articles A from the cutting means in a generally straight-line longitudinal path of travel. This cut article feeding means comprises endless conveyors 50 extending in the generally straight-line longitudinal path of travel of the cut articles A and mounted by suitable pulleys (FIGS. 5 and 8–12) on an apparatus frame section 51 having an upper table-like guide surface 52 so that the upper flights of the endless conveyors 50 extend along the top of the table-like guide surface 52 for successively receiving the cut articles A from the guide plate 26 after being cut by the cutting means and feeding such cut articles A forwardly in a generally straight-line longitudinal path of travel. The endless conveyors 50 are suitably driven, such as by a belt and pulley mechanism 54 from a drive motor 55 (FIG. 5).

Figure 8:
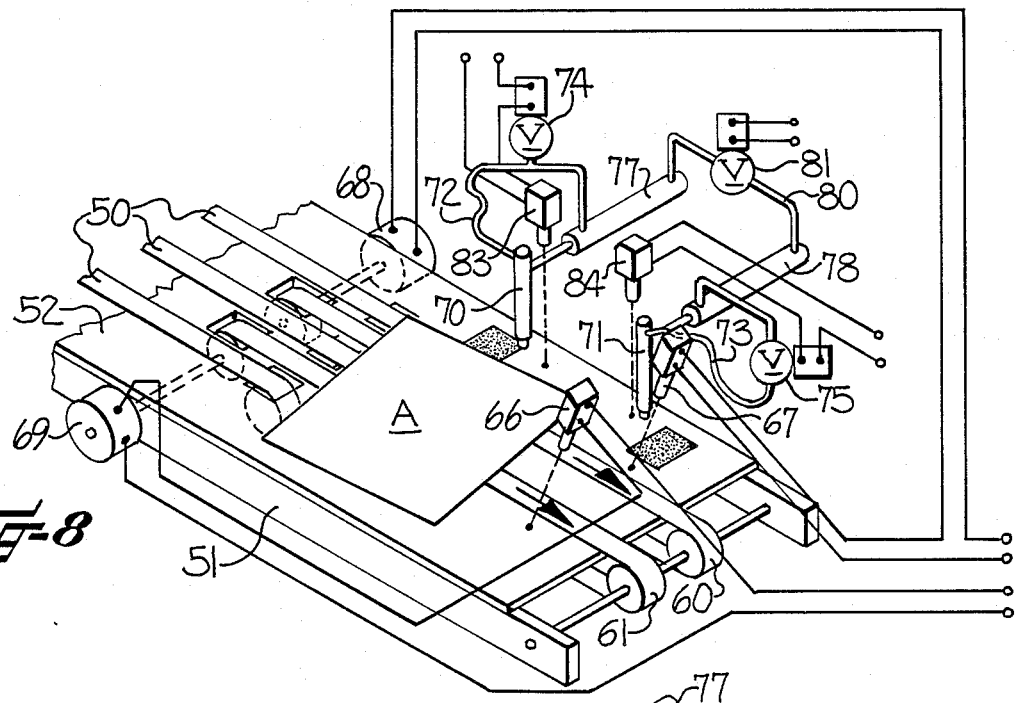
FIGS. 8–12 are sequential views showing operation of the mechanisms for squaring the cut articles in their straight-line longitudinal path of travel for pick-up by the robot mechanism of the first embodiment of apparatus.
Figure 9:
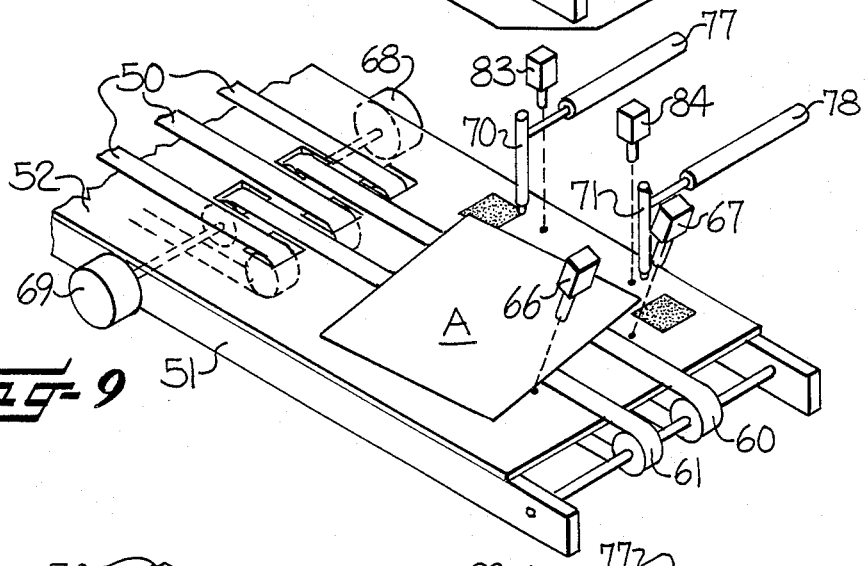

Inasmuch as the articles A are often askew or in an un-squared position with respect to the straight-line longitudinal path of travel (FIG. 1), the first embodiment of apparatus further includes means for successively receiving the cut articles A from the above described article feeding means and for squaring the cut articles A in the straight-line longitudinal path of travel. This squaring means includes first and second independently-driven spaced-apart endless conveyors 60, 61 mounted by suitable pulleys (FIGS. 5 and 8–12) on frame section 51 so that the upper flights of such endless conveyors 60, 61 extend from within the upper flights of endless conveyors 50 in a straight-line longitudinal direction along the table-like support 52 to be positioned for successively receiving the cut articles A thereon and conveying the cut articles A forwardly in the straight-line longitudinal path of travel (FIG. 8). The endless conveyors 60, 61 are suitably driven, such as through their mounting pulleys by a belt and pulley drive 64 from the motor 55 (FIG. 5).

The article squaring means further includes first and second edge sensing and control means respectively connected to the first and second independently-driven conveyors 60, 61 and respectively positioned in the straight-line path of travel of the cut articles A for sensing the leading transverse edge of that portion of the cut articles A carried by the respective conveyor means 60, 61 when the cut article A reaches a predetermined position for stopping the drive of the respective conveyor means 60, 61 so that the leading transverse edge of each of the articles A will be squared with respect to the longitudinal straight-line path of travel.

These first and second edge sensing and control means may suitably comprise photoelectric cell sensing means 66, 67 positioned generally toward the ends of the upper flights of the respective conveyors 60, 61. These photoelectric cell sensing means 66, 67 are suitably electrically-connected (FIGS. 5 and 8) to respective electrically-operated air valves (not shown) for operating air-operated clutches 68, 69 in the respective drives for the conveyor means 60, 61. In operation, as each of the photoelectric cell sensing means 66, 67 senses the edge of that portion of the cut article A carried by the respective conveyor means 60, 61 the clutch mechanisms 68, 69 will be actuated to stop the drive of the respective conveyor means 60, 61 (FIGS. 9 and 10) to square the leading transverse edge of the article A (FIG. 10).

Figure 10:
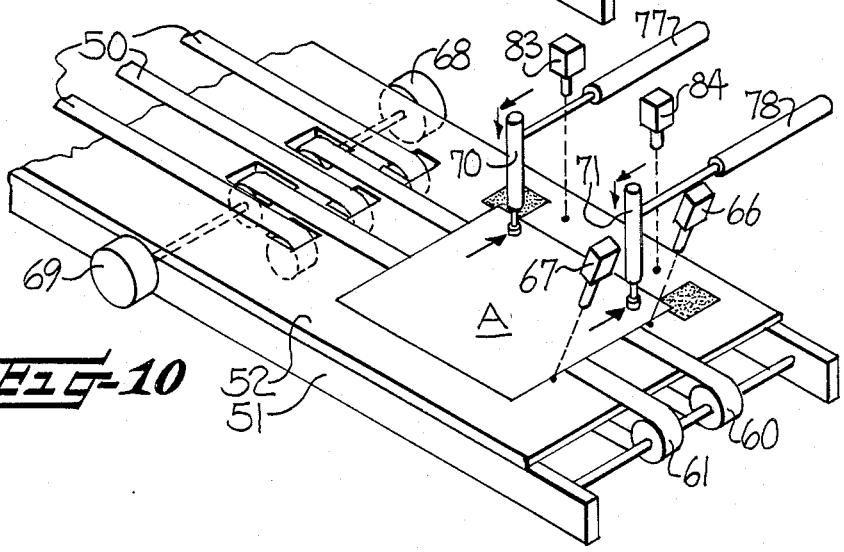
Figure 11:
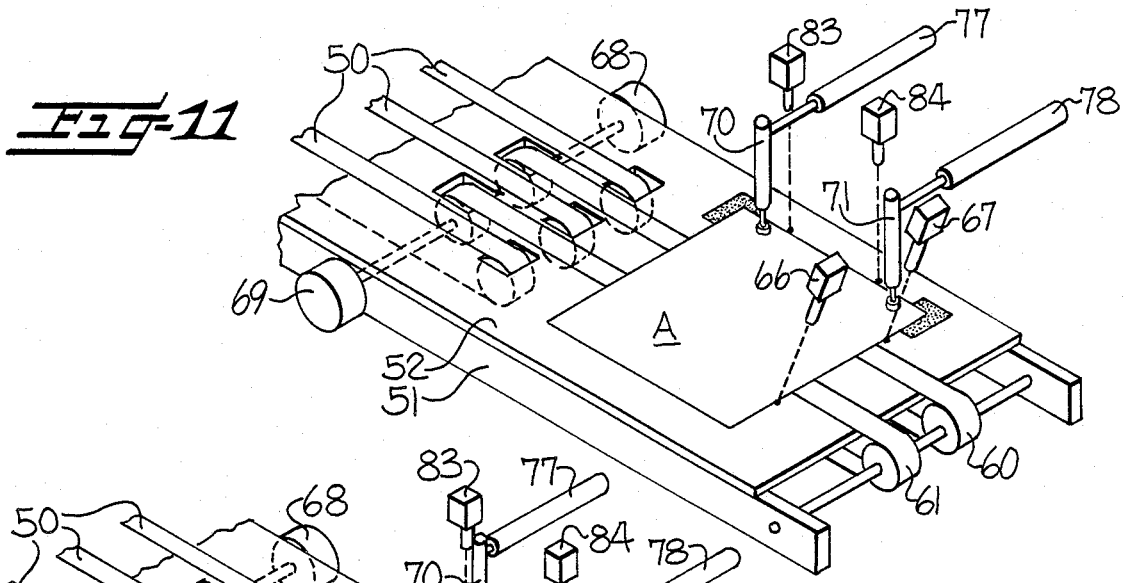
Figure 12:
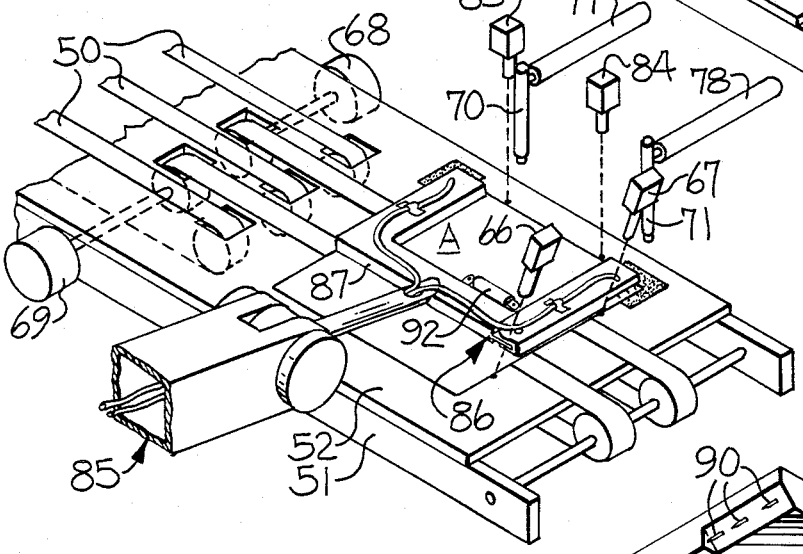
Figure 13:
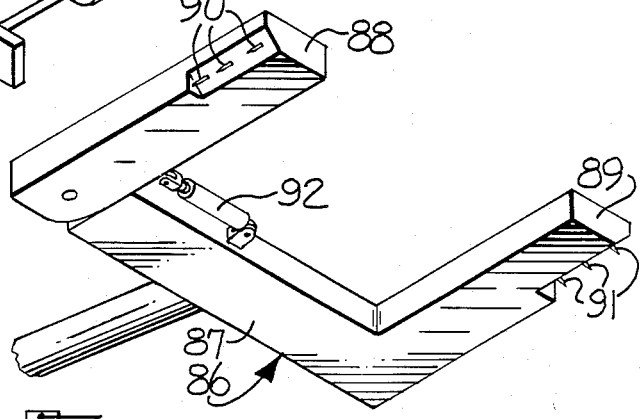
FIG. 13 is a perspective view of the underside of the end effector or gripping mechanism utilized on the robot mechanism.

The means for squaring the cut articles A further includes first and second independently-operated clamp and conveyor means for respectively clamping each successive cut article A at spaced-apart portions along one longitudinal edge after squaring of the leading transverse edge (FIG. 10) and transversely conveying the cut article A (FIG. 10).

These first and second independently-operated clamp and conveyor means may suitable comprise piston and cylinder mechanisms 70, 71 extending generally vertically such that when each of the pistons expand from the cylinders of the piston and cylinder mechanisms 70, 71, it will clamp the longitudinal edge of the cut article (FIG. 10). Fluid may be supplied to the piston and cylinder mechanisms 70, 71 through suitable fluid supply lines 72, 73 and controlled by solenoid-actuated valves 74, 75 (FIG. 8). These first and second independently-operated clamp and conveyor means may further include respective piston and cylinder mechanisms 77, 78 in which the respective pistons are connected to piston and cylinder mechanisms 70, 71 and may be extended and contracted for transversely conveying the piston and cylinder mechanisms 70, 71 and thus the clamp cut article A. Fluid is supplied to the piston and cylinder mechanisms 77, 78 by the respective fluid supply lines 72, 73 controlled by the solenoid operated valves 74, 75 so that the pistons of the piston and cylinder mechanisms 77, 78 are retracted at the same time that the pistons of the piston and cylinder mechanisms 70, 71 are extended (FIG. 8). Fluid may also be supplied to the other end of the cylinders of the piston and cylinder mechanisms 77, by fluid supply line 80 controlled by solenoid-actuated valve 81 (FIG. 8).

The article squaring means further includes first and second edge sensing and control means respectively connected to the first and second dependently-operated clamp and conveyor means for sensing the leading longitudinal edge of that portion of the cut article A carried by the respective clamp and conveyor means when it reaches a predetermined position and stopping operation of the respective clamp and conveyor means so that the longitudinal edge of each of the articles will be squared with respect to the longitudinal straight-line path of travel. These first and second edge sensing and control means may suitably comprise photoelectric cell sensing means 83, 84 respectively electrically connected to solenoid operated valves 74, 75 for sensing the leading longitudinal edge of that portion of the cut article carried by the respective clamp and conveyor means when it reaches a predetermined position (FIGS. 11 and 12) and stopping operation of the respective clamp and conveyor means by actuating the solenoid operated valves 74, 75 to stop retracting movement of the piston of the piston and cylinder mechanisms 77, 78 and release the clamping engagement of the piston and cylinder mechanisms 70, 71 so that the longitudinal edge of the cut article A will be squared with respect to the longitudinal straight-line path of travel.

There is further provided means for successively receiving the cut articles A and edge stitching such cut articles with stitching S to complete fabrication thereof. In the first embodiment of apparatus in accordance with this invention of FIGS. 1–3 and 5–12, such means comprises a plurality of edge stitching means 80, preferably two, for successively receiving and edge stitching the cut articles A. These edge stitching means 80 may be fabric edge finishing machines as produced by United Shoe Manufacturing Corporation of Beverly, Mass. which utilize suitable overedge sewing machines and are adapted for receiving the cut articles A and edge stitching such cut articles A around all four sides thereof to be removed from the machine as finished articles A, which may be in the form of washcloths (FIG. 4). Inasmuch as these machines are commercially available and the operation and construction thereof are well known to those with ordinary skill in the art, further explanation thereof is not deemed necessary herein.

The first embodiment of apparatus further includes robot means for picking up the cut articles A at the squaring means and transporting the cut articles to the edge stitching means 80. In the first embodiment of apparatus, the robot means is in the form of a single robot 85 for successively picking up the cut articles A at the squaring means and transporting the cut articles alternately to each of the plurality of stitching means 80.

The robot 85 may be in the form of a commercially available robot, such as DKP 200 robot model V sold by GCA Corporation of St. Paul, Minn. Such robot includes a rotary waist motion, a rotary shoulder motion, a rotary elbow motion and a rotary wrist motion, each of which includes suitable motor mechanisms (FIG. 3). Since such robot 85 is commercially available and the construction and operation thereof is well known to those with ordinary skill in the art, further explanation of the construction and operation thereof is not deemed necessary herein.

Figure 14:
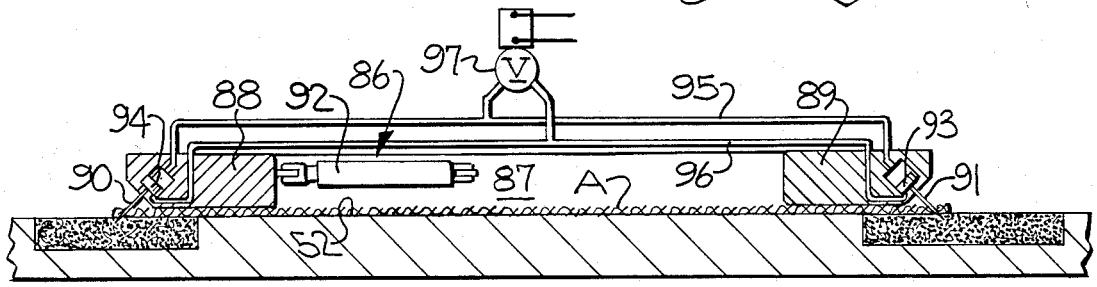
FIG. 14 is a sectional, somewhat schematic, view taken through the end effector of the robot means as it is in position for picking up a cut article, as shown in FIG. 12.

The robot 85 includes an end effector or gripper mechanism 86, specifically designed in accordance with this invention, for alternately gripping and releasing cut textile fabric articles A. The end effector 86 (FIGS. 3 and 12–14) comprises a generally U-shaped member 87 defining two forwardly extending free end portions 88, 89, selectively movable needle gripping means 90, 91 carried by the forwardly extending free end portions 88, 89, respectively and includes means for moving the needle gripping means 90, 91 outwardly at an acute angle with respect to the top surface of the cut article A to penetrate such article to effect gripping by said end deffector 86 (FIG. 12 and 14) and inwardly to effect releasing of the cut article A by the end effector 86 when such cut article A is received within the stitching mechanism 80. The needle gripping means 90, 91 each comprise a piston and cylinder mechanism 93, 94 mounted within the free end portions 88, 89 to extend outwardly therefrom through a cut-out portion at an approximate 45° angle to the top surface of the cut article A (FIG. 14). The piston and cylinder mechanisms 93, 94 are controlled by fluid supply lines 95, 96 which receive fluid through a solenoid-operated valve 97.

Preferably, the U-shaped member 87 of the robot end effector 86 comprises two members (FIG. 13) pivotally connected and including means, in the form of a fluid operated piston and cylinder mechanism 92, for moving the free end 88 of one [L-shaped] member for cooperating with the needle gripping means 90, 91 to aid in gripping and releasing of the cut article.

Further specific details of the construction and operation of the end effector 86 are set forth in copending application Ser. No. 807,856, filed Dec. 11, 1985, and assigned to the assignee of the present invention.

Referring now to the second embodiment of apparatus of FIGS. 15–22, this embodiment also includes a supply source of continuous textile fabric F, means for successively withdrawing predetermined lengths of the textile fabric from the supply source and along a path of travel in a longitudinal direction of the fabric F, cutting means positioned in the path of travel of the textile fabric F for successively transversely cutting the textile fabric F into individual articles of predetermined dimensions and means for successively feeding the cut articles from the cutting means in a generally straight-line longitudinal path of travel. These mechanisms are constructed and operate in exactly the same manner as those mechanisms described above in connection with the first embodiment of apparatus of FIGS. 1–3 and 5–14. Accordingly, the same reference numerals have been applied to these mechanisms in the second embodiment of apparatus and will not be further described.

This second embodiment of apparatus also includes means for alternately receiving the cut articles A from the article feeding means and for squaring the cut articles A in the straight-line longitudinal path of travel, means for successively receiving and edge stitching the cut articles to complete fabrication thereof, and robot means positioned for picking-up the cut articles A at the squaring means and transporting the cut articles A to the edge stitching means. However, these last three described means are somewhat different from similar means described above with respect to the first embodiment of apparatus and will now be separately described with respect to the second embodiment of apparatus.

Figure 15:
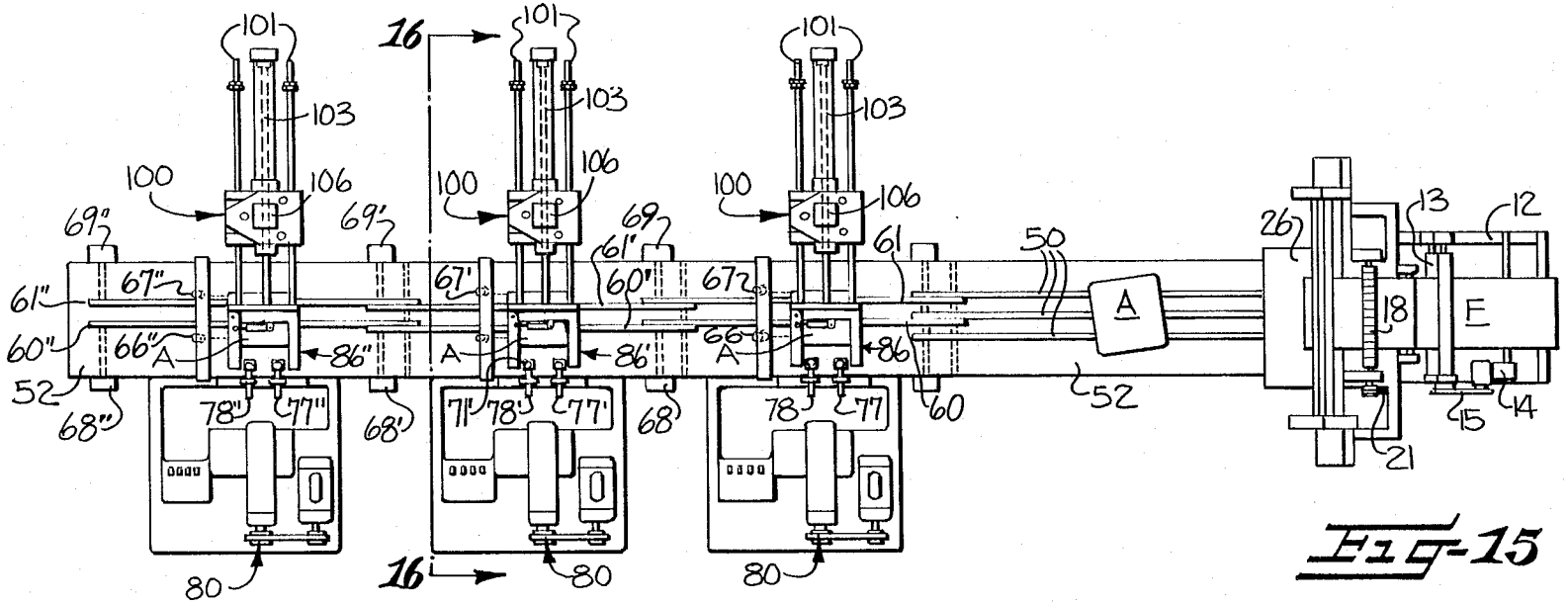
FIG. 15 is top plan view of a second embodiment of apparatus constructed in accordance with this invention.
Figure 16:
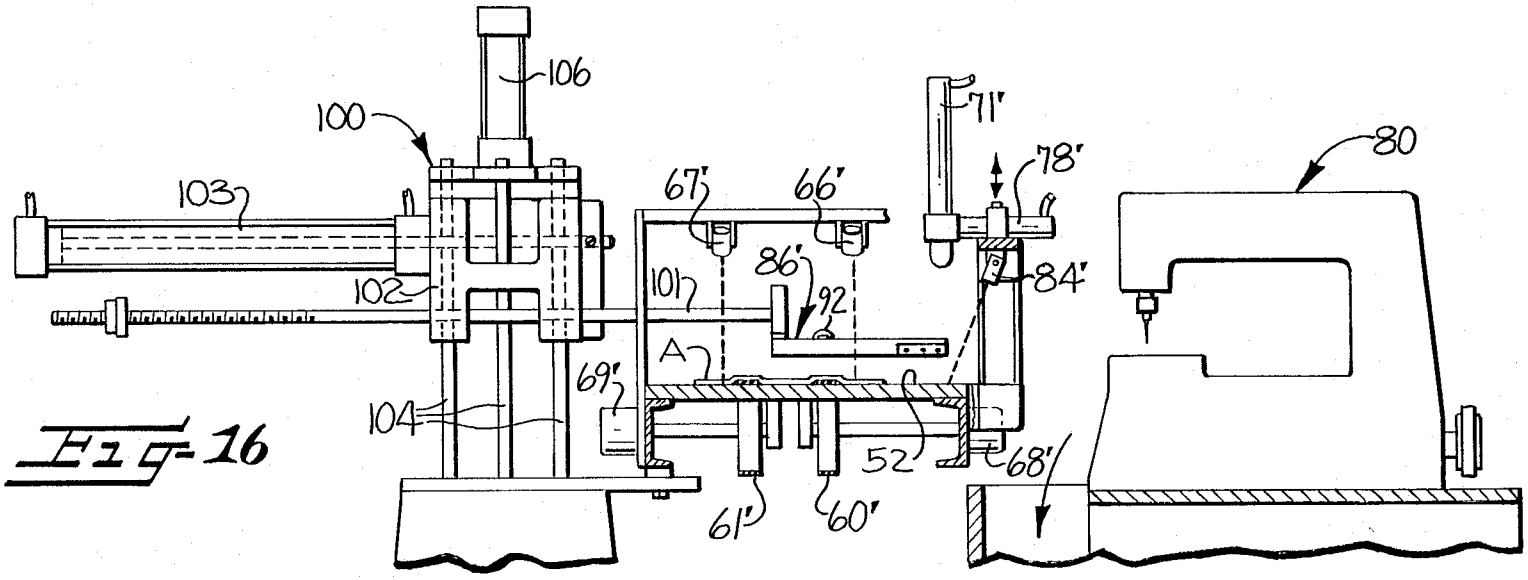
FIG. 16 is a sectional view taken generally along the lines 16—16 of FIG. 15.
Figure 17:
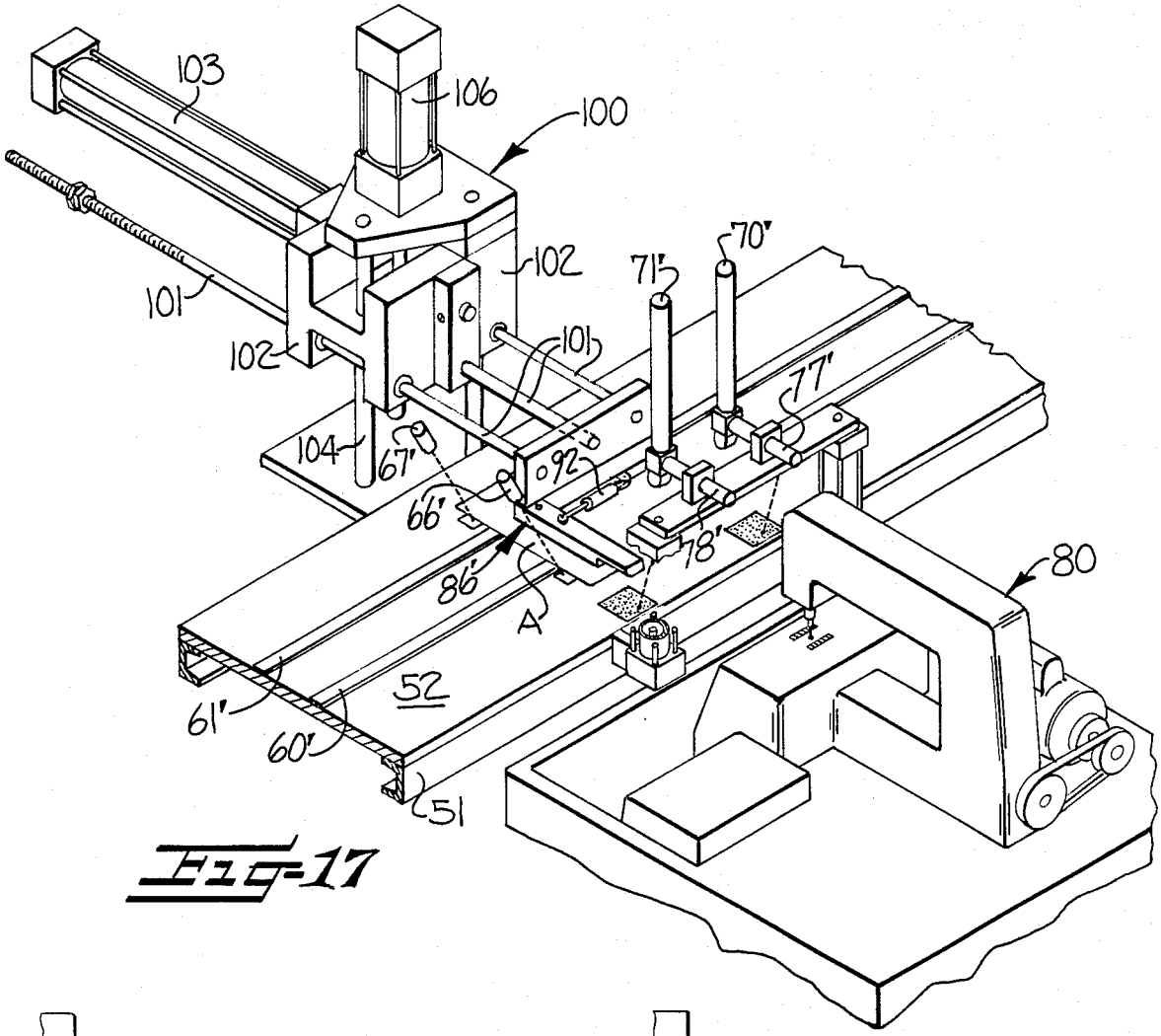
FIG. 17 is a perspective view of a portion of the apparatus of FIG. 15 and generally illustrating the devices shown in FIG. 16.
Figure 18:
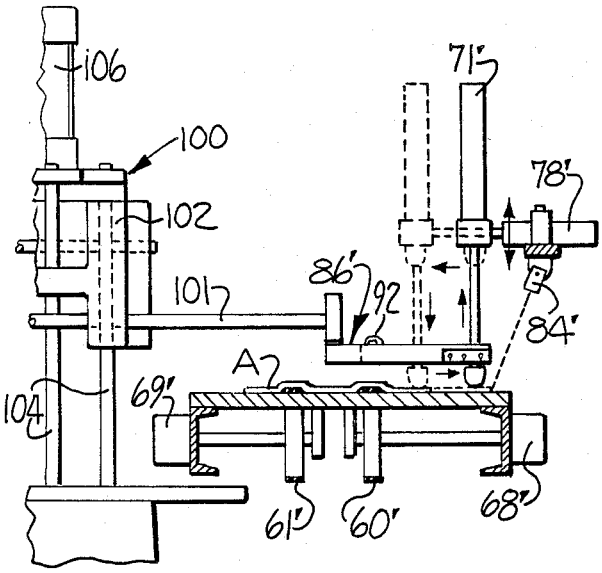
FIGS. 18–21 are sequential views illustrating generally the squaring of the cut articles and the picking-up and transporting of the cut articles by the robot means to the edge stitching means of the second embodiment of apparatus.

The article squaring means in this second embodiment of apparatus includes a plurality, preferably three, separate means for alternately receiving cut articles A from the article feeding means and for separately squaring such cut articles A in the straight-line longitudinal path of travel (FIG. 15).

These article squaring means are positioned in succession following the means for successively feeding the cut articles A from the cutting means in a generally straight-line longitudinal path of travel and are each constructed and operate in the same manner as the single article squaring means described in connection with the first embodiment of apparatus of FIGS. 1–3 and 5–14, above. Accordingly, the same reference numerals have been applied to the mechanisms forming the first article squaring means and the same reference numerals with prime and double prime notations have been applied to these mechanisms forming the second and third article squaring means. Further detailed explanation is not believed to be necessary.

This second embodiment of apparatus also includes means for receiving the cut articles A and edge stitching such cut articles with stitching S to complete fabrication thereof. In this second embodiment of apparatus, such means comprises a plurality of edge stitching means, one of which is positioned adjacent one side of each of the squaring means in the straight-line path of travel of the cut articles A and may be the same type of fabric edge finishing machines described above in conjunction with the description of the first embodiment of apparatus in accordance with this invention and have been given the same general reference numeral 80. Each of such edge stitching means receives the cut article A from the respective squaring means and edge stitches such cut article A around all four sides thereof to be removed from the edge stitching means as finished articles A, which may be in the form of washcloths (FIG. 4). As discussed above in conjunction with the description of the first embodiment of this invention, these edge stitching means are commercially available and the operation and construction thereof are well known to those with ordinary skill in the art; therefore, further explanation thereof is not deemed necessary herein.

Figure 21:
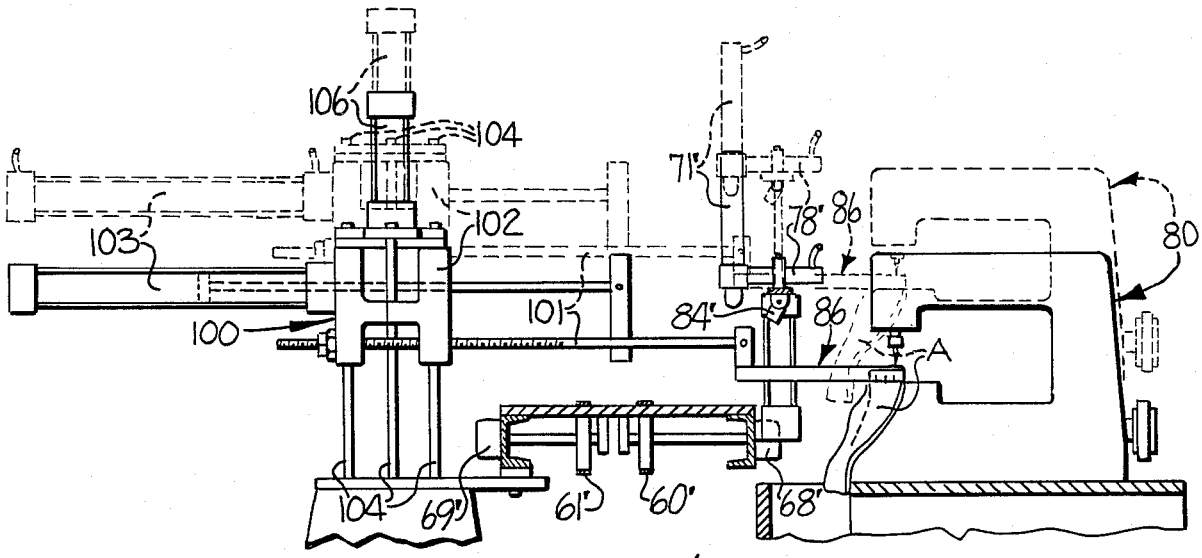
Figure 22:
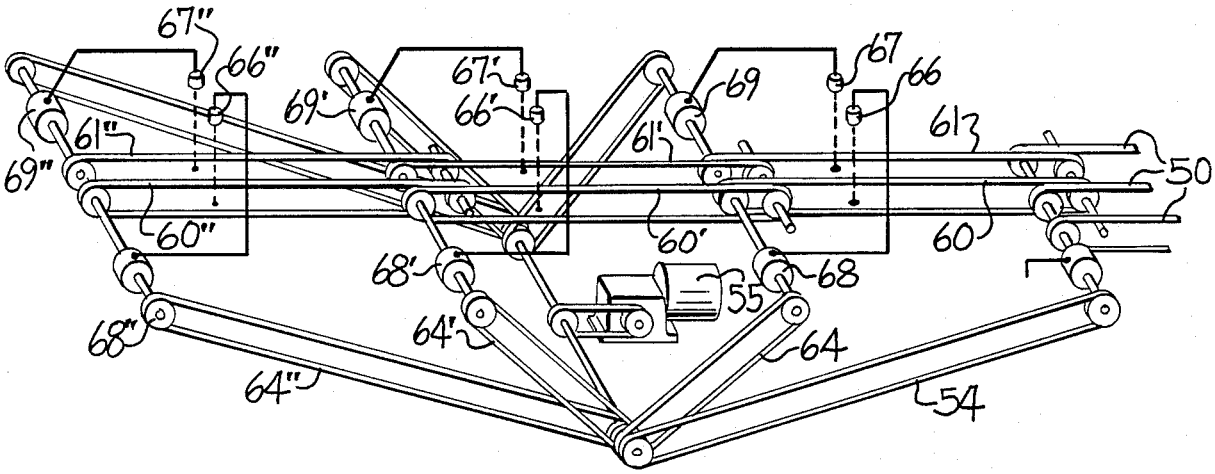
FIG. 22 is a schematic illustration of the drive and control mechanisms utilized in the means for squaring the cut articles of the apparatus of FIG. 15.

This second embodiment of apparatus in accordance with this invention further includes a plurality of robot means 100, one of which is positioned adjacent the other side of each of said squaring means in the straight-line path of travel of the articles A, for successively picking-up the cut articles A at the respective squaring means and transporting the cut articles A to the respective edge stitching means 80 (FIG. 21).

Figure 19:
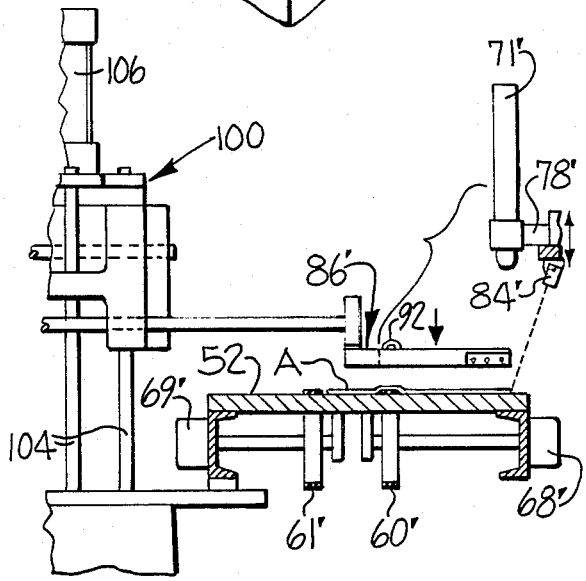
Figure 20:
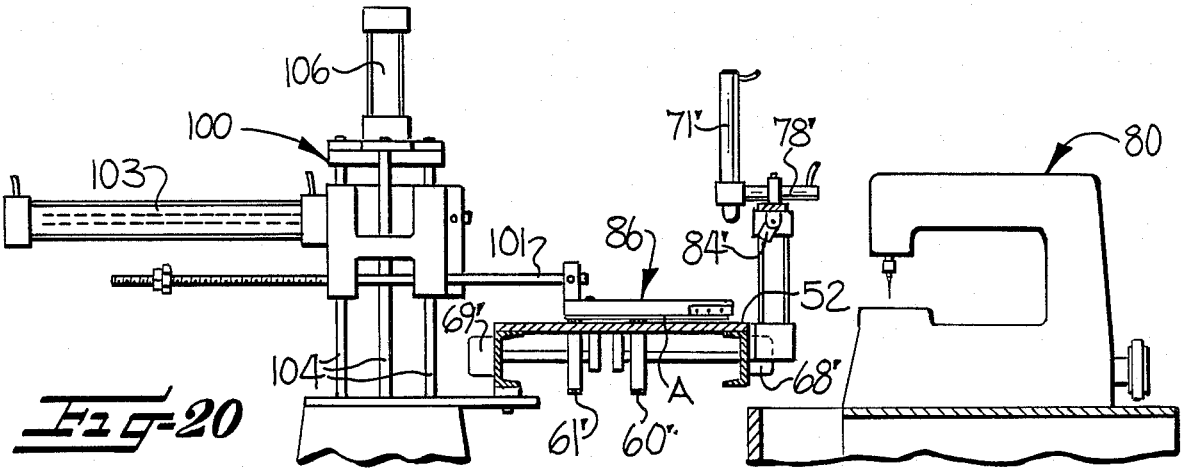

These robot means 100 may be in the form of any commercially available robot which provides for both horizontal and vertical straight-line movement. These robots 100 are a simplified version of the robot 85 used in connection with the first embodiment of apparatus and described above. Specifically, these robots 100 have end effectors or gripper mechanisms 86 constructed as described above with respect to the first embodiment of this apparatus and like reference numerals have been applied thereto. These end effectors 86 are mounted on the ends of rods 101 which extend through a robot frame block 102 and which carries a fluid-operated piston and cylinder mechanism 103 on the other end thereof to effect forward and reverse horizontal movement of the end effector 86 (FIGS. 20, 21). The block 102 is also mounted on guide rods 104 for up and down vertical movement thereon by fluid-operated piston and cylinder mechanism 106 so that the end effector 86 may move from an upward position to a downward position (FIGS. 19 and 20). Fluid may be supplied to each side of the piston and cylinder mechanisms 103, 106 by any suitable control mechanism (not shown). Robot mechanisms for performing such vertical and horizontal movements are widely commercially available and further explanation of the construction and operation thereof are not believed necessary for an understanding of this invention.

The sequential illustrations of the operation of the squaring means and the robot means (FIG. 7–21) will fully illustrate how the cut articles A are squared in each of the squaring means, picked-up at the respective squaring means by the respective robot means 100 and transferred to the respective edge stitching means 80 for completing fabrication of each of the articles A in the second embodiment of apparatus in accordance with this invention.

Preferably, the bed plate of each of the edge stitching means 80 extends well above the level of the upper flight of conveyor belts 60, 61 and 60′, 61′ and 60″, 61″, respectfully, as shown in dotted lines in FIG. 21. Similarly, piston and cylinder mechanisms 106 and 71, 71′, 71″ are of increased length. This arrangement, as shown in dotted lines in FIG. 21, allows the respective robot mechanisms 100 to lift the cut articles A a sufficient distance above the conveyor belts 60, 61 and 60′, 61′ and 60″, 61″ so that additional cut articles A may be fed into position by such conveyor belts while the respective robots 100 are transferring the previously squared-up cut articles A to the respective edge stitching means 80.

Thus, the above detailed description of preferred embodiments of this invention has illustrated and described two embodiments of apparatus for automatically fabricating cut and edge stitched articles A, such as washcloths and the like, from a continuous length of textile fabric F without interruption and without excessive operator time.

In the drawings and specification there has been set forth preferred embodiments of this invention, and although specific terms are employed, they are used in a generic and descriptive sense only and not for purposes of limitation, the scope of the invention being defined in the following claims.

What is claimed is:

1. Apparatus for automatically fabricating cut and edge stitched articles, such as washcloths and the like, from a continuous length of textile fabric; said apparatus comprising:

a supply source of continuous textile fabric, means for successively withdrawing predetermined lengths of the textile fabric from said supply source and along a path of travel in a longitudinal direction of the fabric;

cutting means positioned in the path of travel of the textile fabric for successively transversely cutting the textile fabric into individual articles of predetermined dimensions;

means for successively feeding the cut articles from said cutting means in a generally straight-line longitudinal path of travel;

means for receiving the cut articles from said article feeding means and for squaring the cut articles in the straight-line longitudinal path of travel;

means for receiving and edge stitching the cut articles to complete fabrication thereof; and robot means positioned for successively picking-up the cut articles at said squaring means and transporting the cut articles to said edge stitching means.

2. Apparatus for automatically fabricating cut and edge stitched articles, such as washcloths and the like, from a continuous length of textile fabric; said apparatus comprising:

a supply source of continuous textile fabric, means for successively withdrawing predetermined lengths of the textile fabric from said supply source and along a path of travel in a longitudinal direction of the fabric;

cutting means positioned in the path of travel of the textile fabric for successively transversely cutting the textile fabric into individual articles of predetermined dimensions;

means for successively feeding the cut articles from said cutting means in a generally straight-line longitudinal path of travel;

means for successively receiving the cut articles from said article feeding means and for squaring the cut articles in the straight-line longitudinal path of travel;

a plurality of edge stitching means for receiving and edge stitching the cut articles to complete fabrication thereof; and a single robot means for successively picking-up the cut articles at said squaring means and transporting the cut articles alternately to each of said plurality of edge stitching means.

3. Apparatus for automatically fabricating cut and edge stitched articles, such as washcloths and the like, from a continuous length of textile fabric; said apparatus comprising:

a supply source of continuous textile fabric, means for successively withdrawing predetermined lengths of the textile fabric from said supply source and along a path of travel in a longitudinal direction of the fabric;

cutting means positioned in the path of travel of the textile fabric for successively transversely cutting the textile fabric into individual articles of predetermined dimensions:

means for successively feeding the cut articles from said cutting means in a generally straight-line longitudinal path of travel;

a plurality of means for alternately receiving the cut articles from said article feeding means and for squaring the cut articles in the straight-line longitudinal path of travel;

a plurality of means, one of which is respectively positioned adjacent each of said squaring means in the straight-line path of travel of the articles, for receiving and edge stitching the cut articles to complete fabrication thereof; and a plurality of robot means, one of which is respectively positioned adjacent each of said squaring means in the straight-line path of travel of the articles, for picking-up the cut articles at said respective squaring means and transporting the cut articles to said respective edge stitching means.

4. Apparatus, as set forth in claim 1, 2 or 3, in which said cutting means comprises a rotating circular cutting blade, carriage means carrying said rotating cutting blade for movement transversely across the continuous material, stationary guide means movably carrying said carriage means for the transverse movement, means for alternately moving said carriage means in a first direction transversely across the material for a cutting action by said cutting blade and then in the opposite direction transversely across the material for another cutting action by said cutting blade, and means for alternately rotating said cutting blade in one direction as said carriage means moves in the first direction and then in the opposite direction as said carriage means moves in the opposite direction.

5. Apparatus, as set forth in claim 4, in which said means for alternately moving said carriage means comprises a double-acting, fluid-operated piston and cylinder means, and in which said means for alternately rotating said cutting blade comprises fluid-operated means.

6. Apparatus, as set forth in claim 1, 2 or 3, in which said article squaring means comprises first and second independently-driven spaced-apart conveyor means positioned for receiving the cut articles thereon and conveying the cut articles forwardly in the straight-line longitudinal path of travel, and first and second edge sensing and control means respectively connected to said first and second independently-driven conveyor means and respectively positioned in the straight-line path of travel of the cut articles for sensing the leading transverse edge of that portion of the cut article carried by the respective conveyor means when it reaches a predetermined position and stopping the drive of the respective conveyor means so that the leading transverse edge of each of the articles will be squared with respect to the longitudinal straight-line path of travel to insure proper picking-up by said robot means.

7. Apparatus, as set forth in claim 6, in which said article squaring means further includes first and second independently-operated clamp and conveyor means for respectively clamping each cut article at spaced-apart portions along one longitudinal edge after squaring of the leading transverse edge and transversely conveying the article, and first and second edge sensing and control means respectively connected to said first and second independently-operated clamp and conveyor means for sensing the leading longitudinal edge of that portion of the cut article carried by the respective clamp and conveyor means when it reached a predetermined position and stopping operation of the respective clamp and conveyor means so that the longitudinal edge of each of the articles will be squared with respect to the longitudinal straight-line path of travel to insure proper picking-up by said robot means.

8. Apparatus, as set forth in claim 1, 2 or 3, in which said robot means includes an end effector means for alternately gripping and releasing the cut articles and comprising a generally U-shaped member defining two forwardly-extending free end portions, selectively movable needle gripping means carried by said forwardly-extending free end portions and including means for moving said needle gripping means outwardly at an acute angle with respect to the top surface of the cut article to penetrate such article to effect gripping by said end effector and inwardly to effect releasing of the cut article by said end effector.

9. Apparatus, as set forth in claim 8, in which said generally U-shaped member of said robot end effector comprises two members pivotally connected and including means for moving said free end portion of one member toward and away from said free end portion of the other member for cooperating with needle gripping means to aid in gripping and releasing of the cut article.

10. Apparatus, as set forth in claim 9, in which said means for moving said needle gripping means and said means for moving said one member of said U-shaped member comprise fluid operated piston and cylinder means.

* * * * *